US011185753B2

(12) United States Patent
Caldwell

(10) Patent No.: US 11,185,753 B2
(45) **Date of Patent: *Nov. 30, 2021**

(54) WRIST WORN MONITORING DEVICE

(71) Applicant: Theodore Weissenburger Caldwell, Laguna Beach, CA (US)

(72) Inventor: Theodore Weissenburger Caldwell, Laguna Beach, CA (US)

( * ) Notice: Subject to any disclaimer, the term of this patent is extended or adjusted under 35 U.S.C. 154(b) by 412 days.

This patent is subject to a terminal disclaimer.

(21) Appl. No.: 15/791,929

(22) Filed: Oct. 24, 2017

(65) Prior Publication Data

US 2019/0070477 A1 Mar. 7, 2019

Related U.S. Application Data

(63) Continuation of application No. 13/400,084, filed on Feb. 19, 2012, now Pat. No. 9,795,853, which is a continuation of application No. 11/243,699, filed on Oct. 6, 2005, now Pat. No. 8,123,624.

(60) Provisional application No. 60/657,999, filed on Mar. 3, 2005.

(51) Int. Cl.

| | |
|---|---|
| ***A63F 9/24*** | (2006.01) |
| ***A63B 69/36*** | (2006.01) |
| ***A63B 60/46*** | (2015.01) |
| ***A63B 71/06*** | (2006.01) |
| *A63B 102/32* | (2015.01) |
| *A63B 102/18* | (2015.01) |
| *A63B 69/00* | (2006.01) |
| *A63B 69/38* | (2006.01) |

(52) U.S. Cl.

CPC ..... *A63B 69/3623* (2013.01); *A63B 60/46* (2015.10); *A63B 69/3608* (2013.01); *A63B 71/06* (2013.01); *A63B 69/0026* (2013.01); *A63B 69/38* (2013.01); *A63B 2071/0663* (2013.01); *A63B 2102/18* (2015.10); *A63B 2102/32* (2015.10)

(58) Field of Classification Search

CPC ..... A63B 69/3623; A63B 69/3608; A63B 2060/464

See application file for complete search history.

(56) References Cited

U.S. PATENT DOCUMENTS 6,162,185 A * 12/2000 Amano ..... A61B 5/021 600/502
7,140,248 B1 * 11/2006 Brundage ..... A63B 69/3608 73/492
2003/0163287 A1 * 8/2003 Vock ..... A61B 5/1118 702/187

OTHER PUBLICATIONS

Rekimoto, J. Gesturewrist and gesturepad: Unobtrusive wearable interaction devices. In ISWC '01, 21-27, 2001 (7 pages).
Amento, B., Hill, W., and Terveen, L. The sound of one hand: a wrist-mounted bio-acoustic fingertip gesture interface. In Proc. CHI '02, 724-725, 2002 (2 pages).

* cited by examiner

*Primary Examiner* — David L Lewis
*Assistant Examiner* — Eric M Thomas
(74) *Attorney, Agent, or Firm* — Brian J. Pangrle

(57) ABSTRACT

A wrist worn muscle movement monitoring device includes a wrist strap; a sensor that responds to muscle movement at a wrist wearing the wrist strap; and monitoring circuitry connected to the sensor.

15 Claims, 7 Drawing Sheets

2 Function LCD

2 Function LCD

3 Function LCD radar reading: 64 miles / second maxX – minX = 60

WRIST WORN MONITORING DEVICE

This application is a continuation of U.S. patent application Ser. No. 13/400,084, filed 19 Feb. 2012 (now U.S. Pat. No. 9,795,853), which is incorporated by reference herein and which is a continuation of U.S. patent application Ser. No. 11/243,699, filed on Oct. 6, 2005 (now U.S. Pat. No. 8,123,624), which is incorporated by reference herein and which claims the benefit of the filing of U.S. Provisional Patent Application Ser. No. 60/657,999, entitled "SHOT-WATCH", filed on Mar. 3, 2005, and the specification of that application is incorporated herein by reference.

BACKGROUND

1. Field of the Invention

This invention is directed to swing training or a swing teaching device, in general and to such a training device in the form of a strap or band to be worn on the wrist of the user and which incorporates components and assemblies for measuring various parameters of a swing.

2. Prior Art Statement

Of the sporting and recreational activities addressed by the instant invention, golf is the oldest with a long and well documented history. Golf is also the game with a tradition of various gadgets designed to help improve proficiency. Until very recently, say the last 25 years, the equipment used was rather basic, if not primitive. Now that modern technology has come into the game, the equipment and apparatuses dedicated to the game are becoming more and more technologically advanced or sophisticated. In the other sporting activities addressing in this document there are very few devices designed or intended to assist in learning or improving skill level or proficiency. Therefore our discussion of background will be confined to the game of golf.

Globally there are over 100 million golfers. A significant percentage of this number are what are called "avid golfers" not just in terms of playing frequently, but also relative to the lengths to which they will go to improve their ability. There is some vague correlation between proficiency and satisfaction.

Improving one's swing is one of the ways golfing enthusiasts can increase their proficiency. There are special clubs, weights, video tapes and many other techniques for utilization during practice rounds or driving range sessions. The extant learning devices are primarily based on the feedback the golfer receives from them and thus learn the correct technique while avoiding wrong techniques.

One of the more subtle difficulties encountered by most golfers is the timing and speed of the swing and the grip exerted on the club. There is no absolutely correct tempo, speed or club grip of the swing. Trial and error is the only reliable way to discover the swing that produces a long, straight shot. Once that discovery is made the golfer needs to development muscle and tempo memory in order to repeat the swing and hence replicate the desired result.

One device known in the art that helps the golfer in some sense memorize and repeat the same golf swing that produces the desired result is a glove worn on the hand of the user as described in U.S. Pat. No. 5,733,201 by the same inventor. While the glove unit is a highly accurate and desirable device, it has the inherent drawback that it is in the form of a glove. The glove is not interchangeable to allow use by either a right-handed or left-handed golfer, there is significant variation in sizing and the glove can not be made as durable as the monitoring instrumentation attached to it.

SUMMARY

The instant invention is directed to a training device in the form of a wrist watch. The timing or tempo of a golfer's club swing is detected by a motion sensor or accelerometer housed in a watch casement. The elapsed time of the swing and club head speed are captured via activation at the beginning of the swing and termination of the time interval is determined as being at the point of contact with the ball. The elapsed time in milliseconds and the club head speed in miles per hour are digitally displayed on the watch face. Grip pressure is monitored via one or more piezo ceramic sensors embedded in a wrist strap and wired to the circuitry in the electronics package.

We observe that the gripping pressure of the hand is proportional to the muscle movement at the wrist: when the hand applies gripping pressure on a club, the muscle group at the wrist moves toward elbow. As a result, the muscle's volume at the wrist decreases, when the hand relaxes, the muscle's volume at the wrist returns to its original size.

We claim that a device consisting of a wrist strap and a pressure-sensing piezo sensor can be used to measure the muscle movement at the wrist, and therefore, the gripping pressure. A piezo sensor is strapped at the underside of the wrist. The strap is tight enough so that some pressure is applied to the piezo sensor. When the hand increases gripping pressure on a club or handle, that tension produces a detectible expansion and contraction in the circumference of the wrist. This implies that the muscle volume enclosed by the strap decreases. As the muscle volume decreases, the pressure on the pressure-sensing piezo sensor decreases accordingly.

The invention possesses memory functions which allow the user to save the tempo, speed and grip readings following the swing that produces good results. In other words, on a driving range the golfer hits a long, straight shot. He simply presses the SAVE button on the invention and the parameter values will be retained in memory. These values or pre settings become the benchmark values against which subsequent golf swings are compared. Should the values on the subsequent swing differ from the pre-settings, an error message in the form of an audible signal will be activated.

The range of tolerance before an error message is generated is also variable. The invention possesses a HANDICAP setting. Should the user set a very low HANDICAP, say approaching zero, the error message or signal will be generated by very slight departure from the parameter values. Conversely, higher HANDICAP settings will be more forgiving with a larger margin of error before generating a signal.

Thus the utility of the invention is to enhance muscle memory, helping the golfer learn to groove his or her swing. The nearly instantaneous feedback makes the user aware that they have either repeated their best swing or failed to do so. As with most motor skills, the greatest proficiency is achieved through repetitive trials. The error factors in statistically significant trials will generally distribute normally. This invention seeks to heighten and narrow that distribution (modal) by providing instantaneous information ideally leading to the reduction of error signals over repeated trials.

DESCRIPTION OF A PREFERRED EMBODIMENT

Figure 1A:
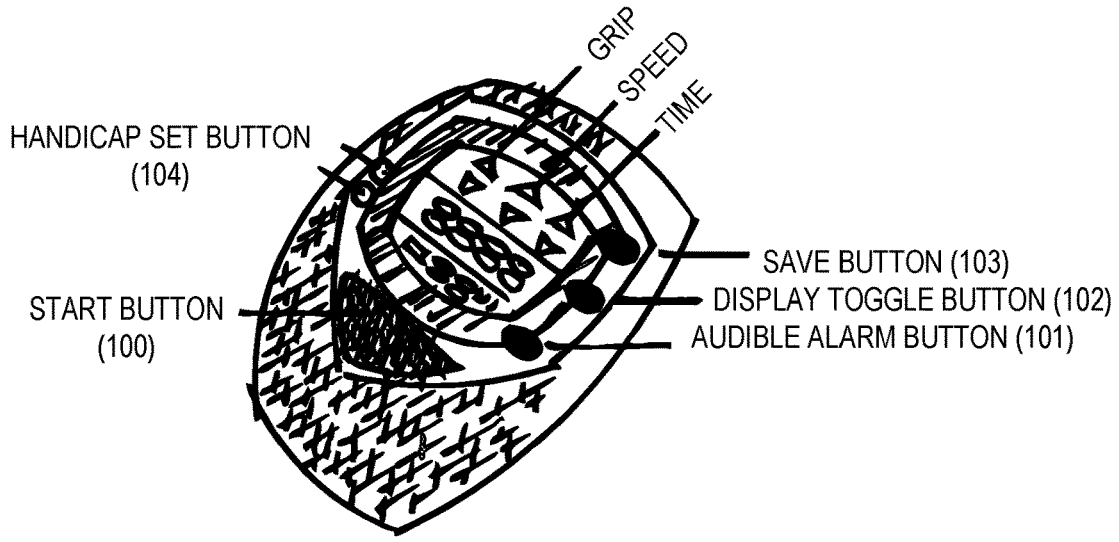
FIG. 1A and FIG. 1B are schematic drawings of one embodiment of the training device of the instant invention. Each of the operator controls is identified.
Figure 1B:
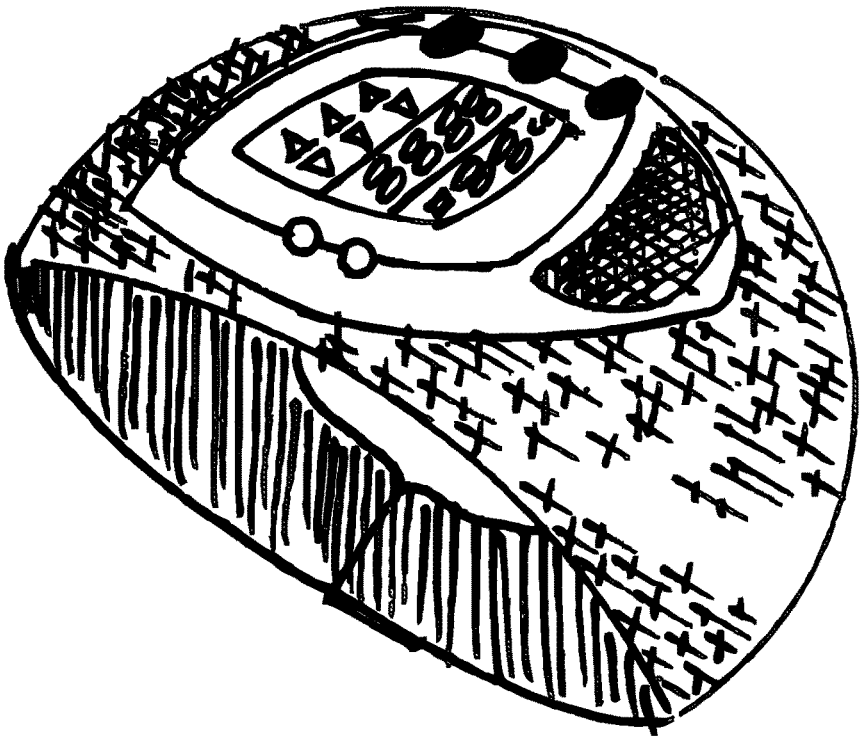

FIG. 1 is a schematic representation of one embodiment of the instant invention. In particular, this configuration includes a rubberized, vinyl wrist strap and a metal monitor housing or instrumentation package. The electronics package inside the housing can be removed from the strap if desired. The controls are operated by the user in the following sequence. The START BUTTON (100) activates the instrument. Next the user sets his or her HANDICAP (104) indicating their particular skill level. For example, a handicap close to "00" would indicate a high level of golf proficiency. As the value of the handicap setting is increased, approaching "99" the user's skill level is assumed to decrease. Functionally this translates to a highest level of precision or exactness required of the "00" handicap user or Scratch Golfer as opposed to a more forgiving standard the higher the handicap.

The AUDIBLE ALERT ON/OFF BUTTON (101) activates the signaling device that will sound or buzz when the user fails to replicate the swing he or she has saved following the swing that produced the results needed to replicate the saved or benchmark swing. In particular, on a driving range, a golfer will hit a sequence of golf shots. Presumable, only longest and the straightest one of those shots will be saved. The user accomplishes this by simply pressing the SAVE BUTTON (103). The data from the saved shot is compared to values recorded by the invention on subsequent shots. Departures from the saved values are detected and the audible signal is activated. (101)

The DISPLAY TOGGLE BUTTON (102) is manually pressed at two different stops. A lighter touch activates the display of the tempo or elapsed time of the swing variable in milliseconds. The timing sequence for the interval begins with the start of the back swing and finishes when the club end first begins to slow drop or decelerate. Theoretically and empirically this is precisely at the instant of impact of the club head with the ball. When the user depresses the DISPLAY TOGGLE BUTTON (102) with slightly more pressure, the maximum club head speed will be displayed in miles per hour.

Figure 2A:
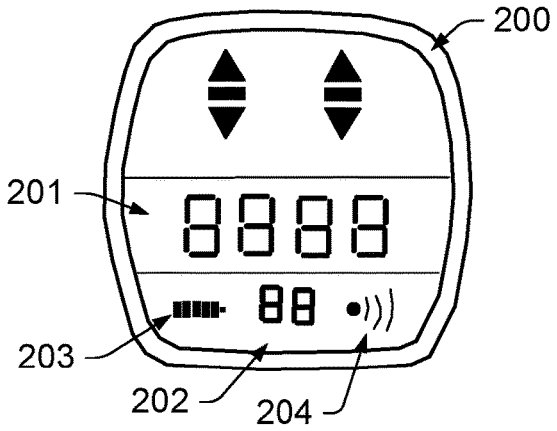
FIG. 2A and FIG. 2B are schematic representations of one design of a monitoring unit of the instant invention including the display area.
Figure 2B:
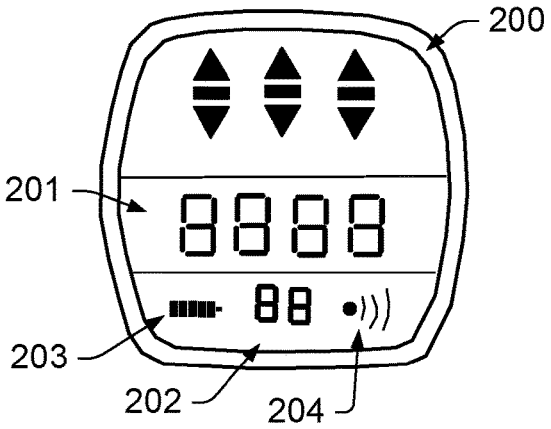

FIGS. 2A and 2B are representations of the liquid crystal display (LCD) layouts of the instant invention. Reference is made concurrently to FIGS. 1A and 1B and 2A and 2B. As noted in the legend accompanying FIGS. 2A and 2B, the Speed or Velocity, Time and Grip Arrows (200) indicate whether the trial shot, that is, shots or swings taken after the reference or benchmark swing has been saved, replicate the benchmark shot. The Arrows (200) indicate the direction of the error or deviation from the presetting, in either above (plus) the presetting or below it (minus).

In FIG. 2A and FIG. 2B, as indicated by arrows and reference numerals, each of the displays may show:

- 200. Speed, Time, and Grip Arrows indicate whether swing is over (plus) or under (minus) the pre-settings.
- 201. Large numerals are realized values for club head velocity (mph), elapsed time of the swing (m/secs) and the constancy of the grip pressure exerted.
- 202. Handicap is self designated settings based on the user's estimated golfing expertise where 00 is best, 99 is worst.
- 203. Battery life is indication by Illumination.
- 204. Audible Alert Volume indicator.

Figure 5:
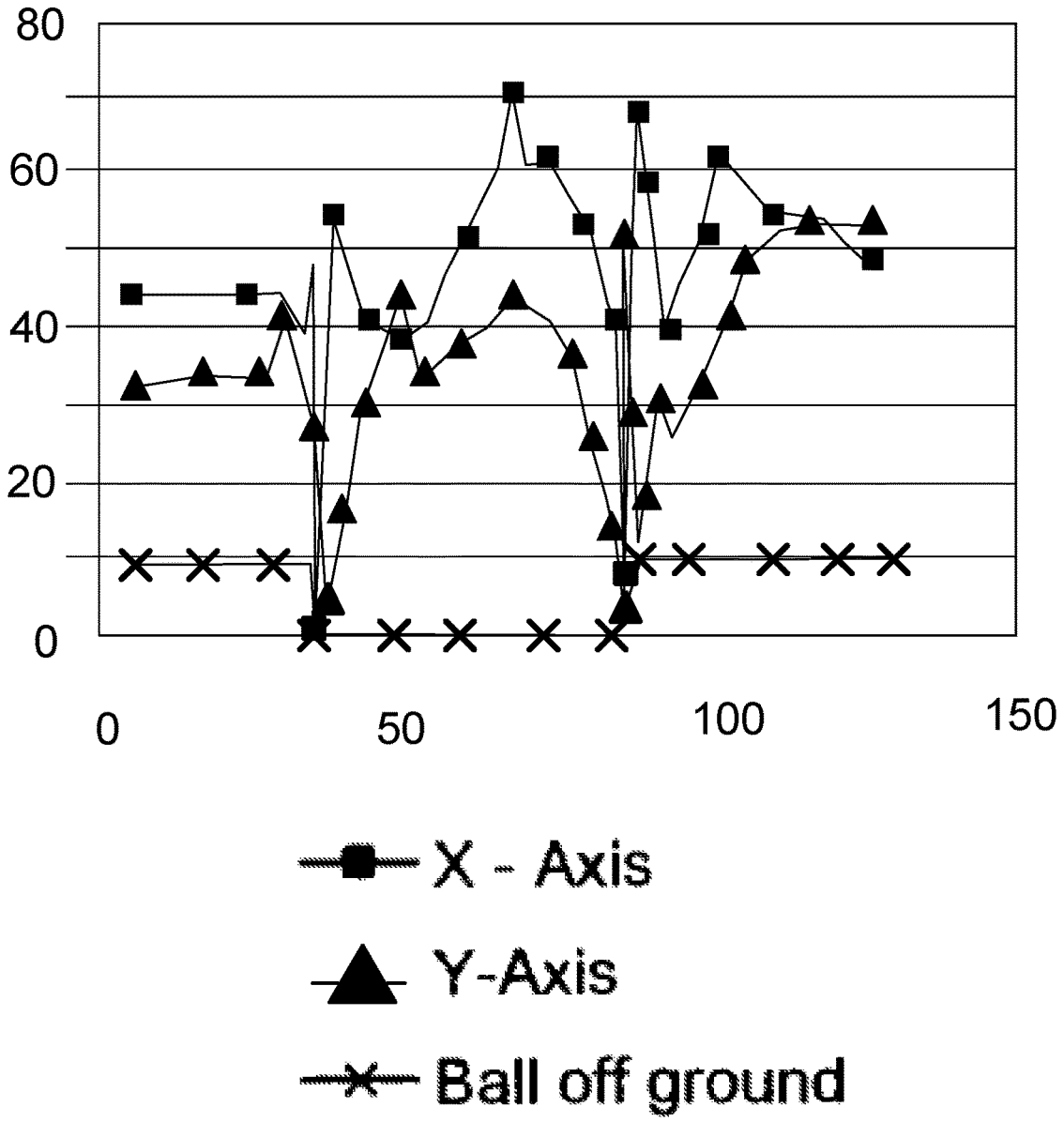
FIG. 5 is a graphic display of the speed or velocity data of an actual golf swing as recorded by the instant invention. Physical time is displayed along the horizontal axis.

The actual obtained values for club velocity, for the elapsed time of the shot and for the range of grip pressures are displayed on the face of the LCD or watch face. (201) Velocity or speed is expressed as approximating miles per hour. The calibration of velocity was achieved through field trials where several extant speed measurements instruments, mostly radar based, were used to validate the accuracy of the instant invention. In fact force, as well as velocity is a factor in the derivation of the measure we are calling speed. As FIG. 5 illustrates, the instant invention generates values corresponding to downward momentum, reaching a maximum value at the moment of contact between the club head and the ball. Through a series of data transformations embedded in the programming, we were able to produce a number representing maximum speed closely corresponding to those registered on radar speed detectors.

As pointed out the HANDICAP SET (202) is user designated. As the user's skill level improves, and the HANDICAP SET (202) will ultimately approach 00, the margin of error can be diminished to the point where virtually no deviation from the benchmark setting can be detected. Conversely, the beginner might care to set the HANDICAP SET (202) at a high or mid range point range, say 25 to 30. At these settings the invention allows a wide margin or error before activating the AUDIBLE ALERT SIGNAL. (204). The volume on the AUDIBLE ALERT SIGNAL (204) can be adjusted to accommodate the ambience. Alternatively, the volume can be turned off while the AUDIBLE ALERT SIGNAL volume indicator will illuminate, indicating the user has executed a swing outside the parameter settings of the benchmark swing.

Finally there is a BATTERY LIFE INDICATOR (203) on the LCD. As the 3 volt lithium battery runs low on charge, the user will be able to determine from visual inspection when the battery needs changing. Several features are programmed into the instant invention to conserve battery life. For example, when no swinging motion is executed by the user after a benchmark swing has been saved for 30 seconds, the device automatically goes into sleep mode. Only the memory of the pre-settings are retained while no other functions will be operational until the START BUTTON (100) is pressed again.

Figure 3:
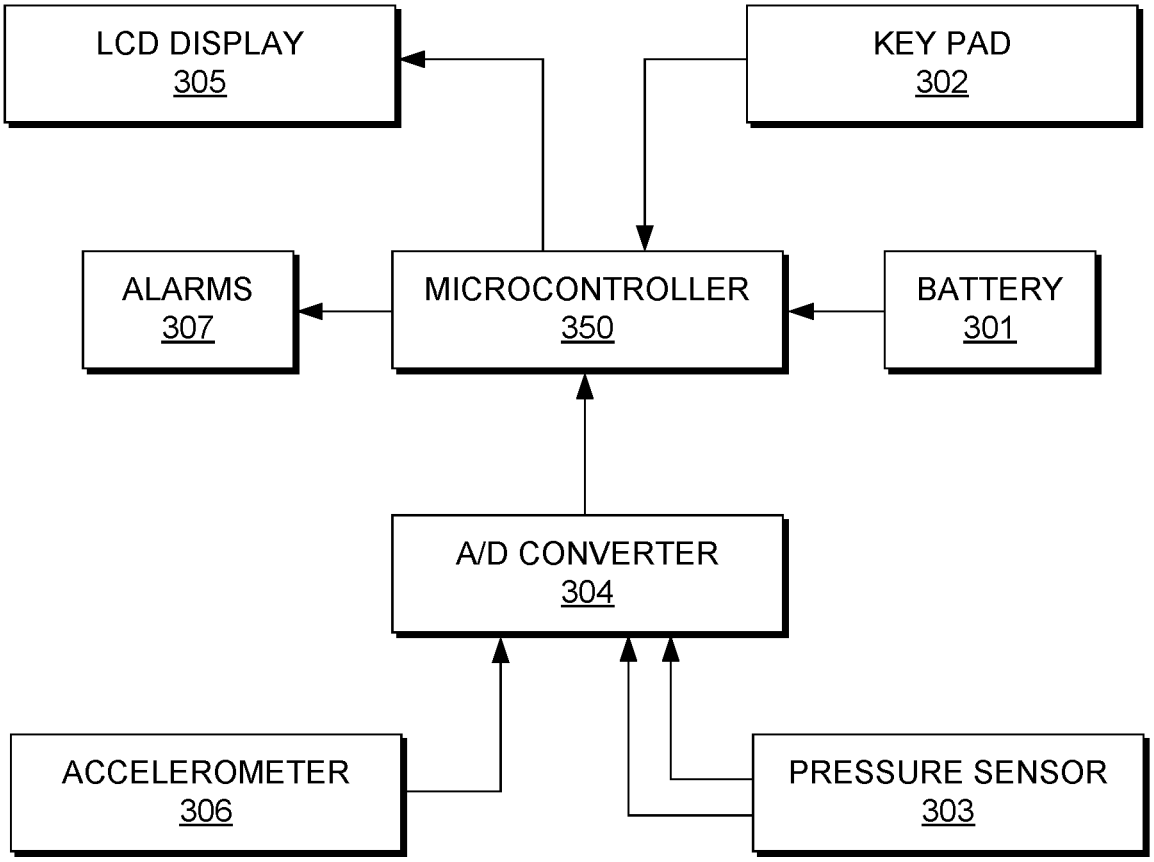
FIG. 3 is a block diagram of one embodiment of the monitoring circuit of the instant invention.

Referring now to FIG. 3, there is shown a block diagram of the swing monitor system 300 of the instant invention. This system is disposed within a suitable housing to form the instrumentation package described in FIG. 1 supra.

In this embodiment, the microcontroller 350 is the basic operational and computational component of the system. The microcontroller 350 can be any type of microprocessor such as a low power CMOS chip of any conventional design.

Microprocessor: There are several choices available from the "off the shelf" stock of chips. Our requirements are for 16 bit CPU with enough memory to support our sophisticated software programs. Some models come ready equipped or preloaded with Analog to Digital Converters (A/D Converter) 304.

Power Supply: 301. A 3 volt battery such as a CR2025 lithium long life battery, powers the invention. As the technology of batteries improves, driven by the demands from the high tech fields of hand held computers and telecommunications devices, longer lasting, and more powerful miniature batteries will become available.

A key pad 302 is connected to the controller 350 in order to apply selective control signals such as limit adjustments, sensitivity adjustments and the like to the operation of the circuitry. The keypad 302 can also include the reset buttons described supra. The keypad 302 can be included in the housing for the package in FIG. 1 noted above. The pressure sensor 303 is representative of a piezo ceramic pressure measuring device and is connected to an A/D converter 304 of conventional design. A typical A/D converter device has an 8-bit resolution and converts the analog signal from the timing device to a digital signal which is then supplied to the microcontroller 350 and may be contained in the microcontroller.

A suitable display 305, for example a liquid crystal display (LCD), is connected to receive output signals from the microcontroller 350. Display 305 represents one (or more) of the displays shown in FIGS. 2A and 2B. The LCD display 305 is of typical design but may be custom made in order to provide any desirable display information such as that shown and described relative to FIGS. 2A and 2B. Of course, the display 305 can be an LED display or any other type of display which is of suitable size and within suitable power parameters.

As noted, an accelerometer 306 can be housed in a wristwatch case along with the other devices. The accelerometer 306 can be included in a unitary package along with all of the other materials and components of the system. One such accelerometer is the ADXL202 by Analog Devices which is two directional and, therefore, capable to measuring acceleration in both positive and negative ranges. In this system, the back-swing will be registered in the negative range while the downswing will register the acceleration of the club head. At the point of contact with the ball, maximum club head in units of MPH will be attained, stored in memory and selectively displayed. The club head will decelerate on the follow through.

Typically, the accelerometer is of conventional design and is aligned with the direction of the swing. The accelerometer measures the force of the swing usually within an acceleration rate of 0 to +/−5 g's.

The accelerometer 306 also produces an analog electrical signal which is supplied to A/D converter 304 for conversion into a digital signal. This digital signal is presented to the microcontroller 350. The signal generated by the accelerometer then is converted to a reasonably accurate approximation of the club head speed which is provided at display 305.

The microcontroller 350, in addition to supplying the signals to the display 305, also can supply signals to alarms 307 mounted in the instrumentation package 224. The alarms can be either audible or visual (or both). The audible alarm can take the form of a buzzer which alerts the golfer to an improper swing in terms of departures from the preset values or parameters saved in memory.

Conversely, the visual alarm 307 can be in the form of an LED or other similar light display which can be used when an audible sound is not desired.

Activation of the instrumentation package occurs when the device is turned on at the START BUTTON 100. Following an eight second interval, the accelerometer 306 such is armed to register motion, and this starts the timing sequence.

The timing or tempo measurement takes place during the interval from back-swing to contact with the ball. Field tests have demonstrated that maximum club head speed is registered at the moment of contact between the club head and the ball. At this instant the timing device stops running and records and displays the elapsed time from the point when the golfer first begins the back swing and ends takes hold of the club when contact is made with the ball.

The accelerometer is also activated on the back-swing. The speed of the club head, which is derived from a semi-log transform of hand speed, is measured in negative ranges until the top of the swing. In the downswing, the club head gains speed or momentum until contact with the ball, at which instant, deceleration begins. The device records and displays the maximum speed obtained.

Basically, the invention is recording non-discrete, continuous data of the type depicted in a curve. For example, the path of the club head through a range of speeds. The invention converts that analog data to a digital format, assigns meaningful values to the converted digital date, i.e. SPEED and TIME, and stores and displays those digital values.

Figure 4:
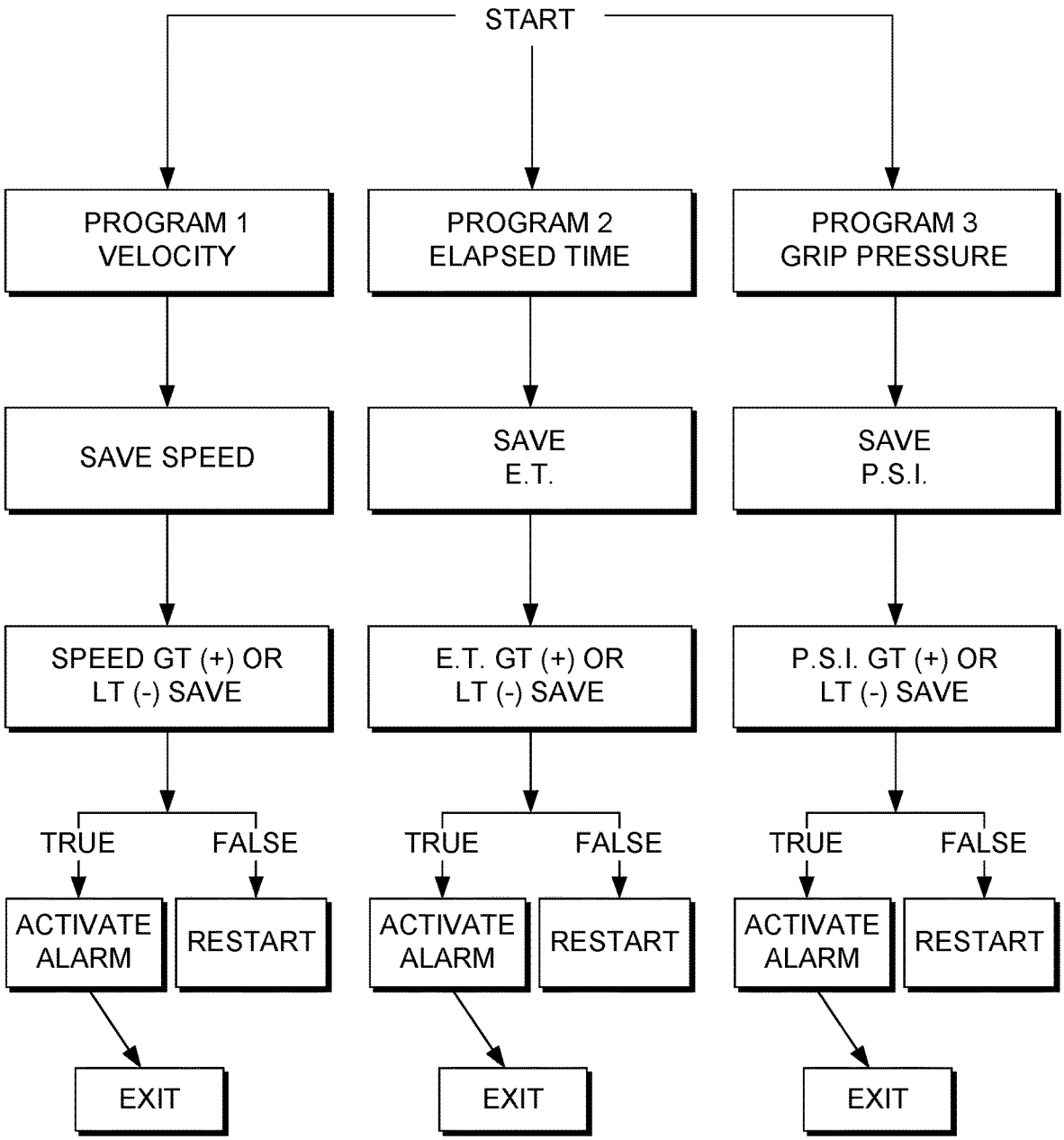
FIG. 4 is a flow chart of the operation of the system shown in FIG. 3.

FIG. 4 is a schematic representation of a flow chart for the operation of the circuit. In one embodiment, this flow chart is representative of the "fuzzy" logic operation of the microprocessor 350. Typically, the flow chart shows two related subroutines processed by microcomputer 350. Program #1 is related to the operation of the accelerometer 306. This program supplies the value of the club speed head in SPEED to display 305. The program is reset by the SAVE BUTTON 103. The speed or velocity of subsequent swings is compared to that stored in memory. If the speed is within the range of tolerance determined by the HANDICAP SET 104, no error signal is generated. If, on the other hand, the club speed is significantly different than the saved parameter, the AUDIBLE ALERT 101 signal is activated Program #2 measures the elapsed time of the golf club swing and drives the display 327. This Program is logically identical to Program #1. The preset values for both the speed and the elapsed time remain in memory until they are reset with the SAVE BUTTON 103.

Program #3 measures grip pressure exerted on the club handle through the swing. A discrete set of pressure readings are taken numbering between seven and fifteen. Readings will commence at the top of the back swing or at the start of the down swing. Subsequent swings will be compared to the SAVED PSI and if similar or identical to those in memory, no error signal if given. Conversely, if pressure readings (PSI) are greater than (GT) or less than subsequent (LT) saved readings as determined by the HANDICAP SET 104, the AUDIBLE ALERT 101 is activated. As with the other two programs, all three loop back to START when the SAVE BUTTON 103 is pressed. In the absence of rearming the WATCH, it will slip into sleep mode and EXIT in 60 seconds. In operation the user turns the power on by pressing the START BUTTON 100. Next the HANDICAP is set. Initially the handicap window will display "00." The range of values are from "01" to "40" for the HANDICAP SET BUTTONS 104. Setting the handicap value establishes the range of tolerances for all subsequent measurements. (High handicap golfers will not be able to exactly replicate their swing on successive tries, while low handicap and scratch golfers will only vary their swing slightly or not at all on repeated swings.)

The user can set one, two, or all three of the variables being monitored. Having set one or more of the variables of the desired swing, the monitor will alert the user to deviations from the preset values. A flashing red light immediately below the SPEED and/or TIME labels will tell which parameter deviations exist. (The range of tolerances for the deviations is determined by the individual handicap.)

To change the values saved in the system, simply press the START button. Otherwise, saved values for the MPH and ET will be retained even if the instrument is turned "Off", i.e. the unit is in the "sleep" mode. Therefore, the next time the unit activated, the last settings will appear.

A "sleep mode" is included to conserve energy when the device is inactive for sixty seconds. In the "sleep mode" the memory retains the last values stored.

In accordance with this invention, the application of over swing or under swing is indicated by sounding an alarm 407 noted above. Through the use of this training device, the golfer can learn to avoid or eliminate any variation from the swing that gives the "best results." By using the Shotwatch as a training device, the golfer can ultimately "memorize" the type of golf swing which is desired to optimize the playing of the game. The utility of this invention is derived from learning theory which in its simplest form attempts to get the learner to repeat what he or she does right, and secondly be made aware of departures or deviations from the correct action on subsequent trials. The golfer on the driving range can use the invention with any club, wood, iron, wedge or putter. Following a swing he or she wishes to repeat, the device will remember the values obtained. For example, one is hitting with a driver. Immediately after a long, straight shot, the golfer merely presses the SAVE BUTTON 103 and the variables will be placed in memory.

A signal will be transmitted, either a buzz or a red light when the golfer deviates from those preset values on the next swing or swings. Depending on the golfer's competence as determined by the Handicap setting 202 which can take on values between 00 and 40, a very good or scratch golfer with a handicap of 00, will get an error signal with only minute departures from the preset values, while higher handicap golfers will have a much greater margin or error.

Thus, there is shown and described a unique design and concept of a swing monitor watch. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

Turning now to FIG. 5, speed along the vertical axis versus time in milliseconds. A centripetal accelerometer tracks motion along two axes. The X-axis is what the instant invention derives the speed measurement from. At the point of contact when the club hits the ball, the speed reading was 60. The duration of the swing as represented by the horizontal axis was approximately 1.40 seconds. When this data was correlated with data collected from radar based speed measuring instruments, the coefficient was sufficiently different from chance, ($r \geq 0.90$) to substantiate the reliability of our measurement. As noted in the legend in FIG. 5, the impact point of the golf club hitting the ball was detected at the peak and dip of the X-Axis corresponding to a speed or velocity reading of 60 m.p.h. Over one hundred iterations provided similar results.

In FIG. 5, as to interpretation, consider the following:

Beginning of the swing: the first dip of the yellow line (Y-axis).

Impact point: the second dip of the yellow line (Y-axis).

Force interaction between the ball and the club: Peak (maximum) and dip (minimum) of the X-axis (pink line) after the impact point.

Figure 6:
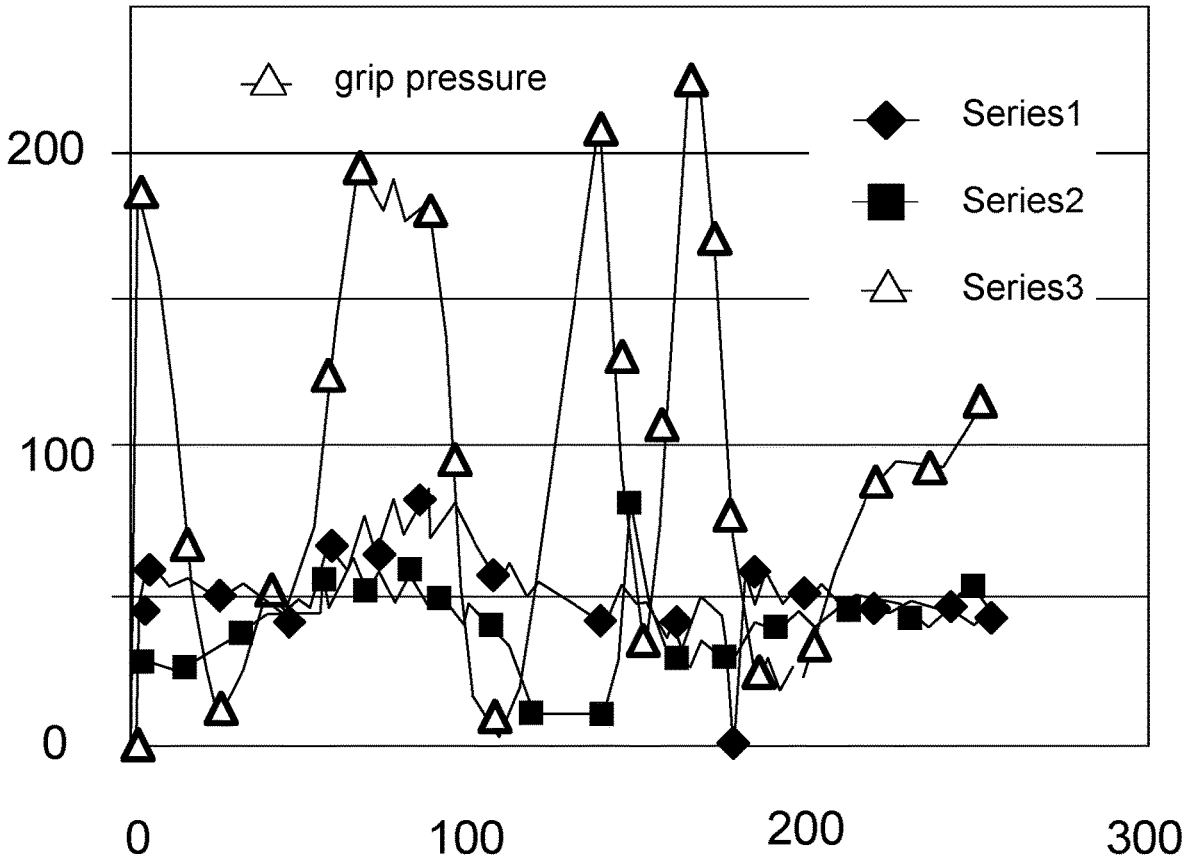
FIG. 6 is a graphic display of the grip pressure data of an actual golf swing as recorded by the instant invention. Physical time is displayed along the horizontal axis.

FIG. 6 represents data from a piezo ceramic pressure sensor embedded in the strap of the instant invention along the vertical axis versus time. Point of impact occurred between 1.10 sec. and 1.30 sec. We derive a single measurement by computing the medium of obtained grip pressure observation after throwing out out-layers, i.e., those more than (plus or minus) three standard deviations from the mean. As previously noted, a benchmark shot or swing will be saved in memory, and subsequent shots or swings will be compared to those parameters saved in memory as described in FIG. 4, Programs 1, 2, and 3.

Figure 7:
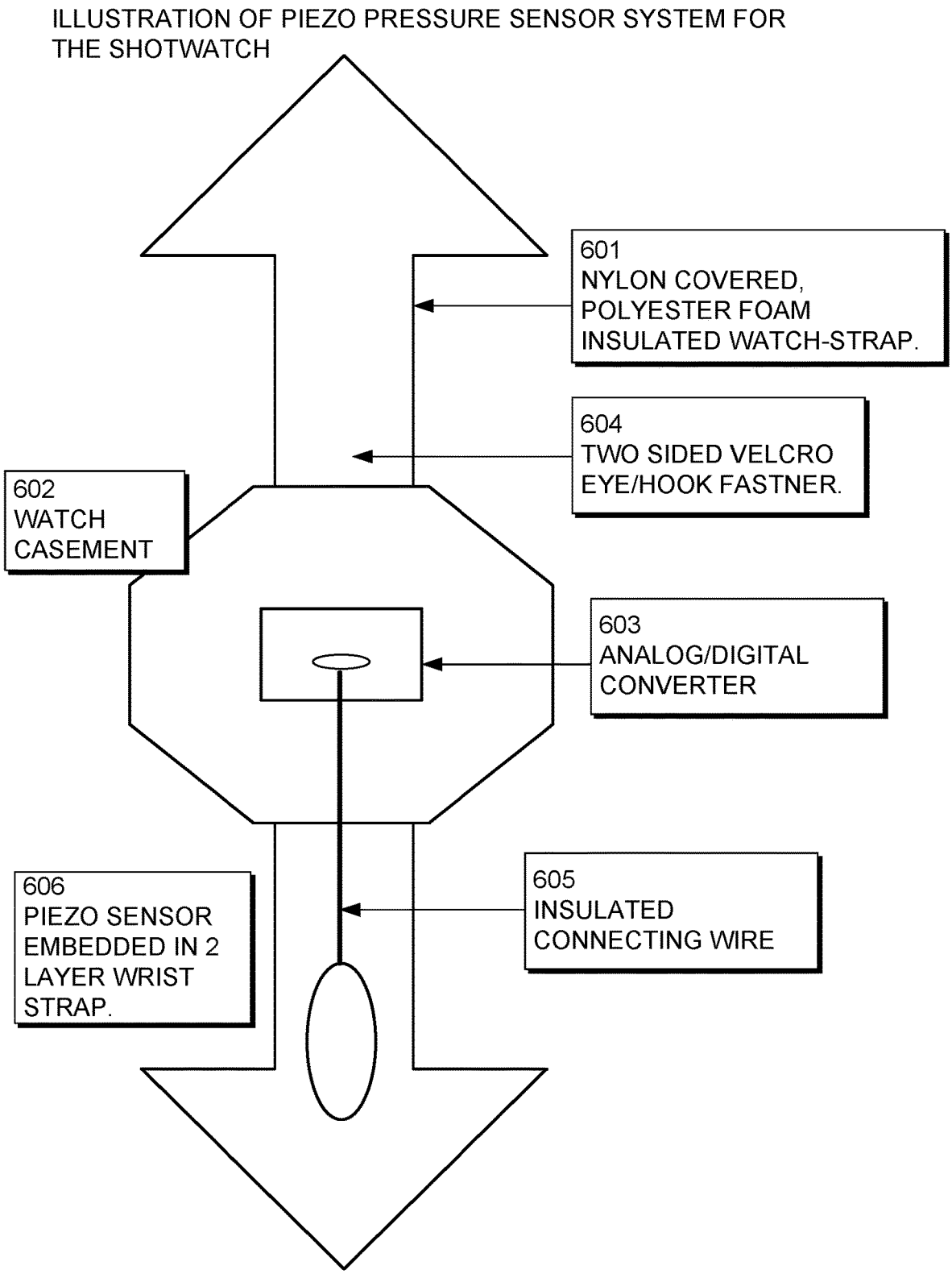
FIG. 7 is a conceptualization of the deployment of the piezo pressure sensor embedded in the watch strap and wired to an analog/digital converter contained in the watch casement.

The drawing in FIG. 7 is a conceptualization of the deployment of the piezo pressure sensor 606 embedded in the watch strap 601 and wired to an analog/digital converter 603 contained in the watch casement 602.

A swing monitoring watch includes a strap adapted to be worn on the wrist or forearm of the user, accelerometer means mounted on the strap, at least one pressure sensor embedded with the strap (where each sensor is a piezo electric sensor), an electronic monitoring circuit, the electronic monitoring circuit connected to each pressure sensor and to the accelerometer means, the electronic monitoring circuit operative to measure the parameters of the pressure exerted on each pressure sensor on the strap, the speed of the strap, and the elapsed time of movement of the strap during a swing of a golf club, racquet, bat, hockey stick or the like, display means connected to the electronic monitoring circuit to display the several parameters defined by movement of the strap and watch during a swinging motion, and housing means mounted on the strap to encase the electronic monitoring circuit and the display means.

A device can include wiring embedded to a band to interconnect each pressure sensor to an electronic monitoring circuit. A device can include converter means connected intermediate each pressure sensor and an electronic monitoring circuit. A device can include converter means that include an analog to digital signal converter. A device can include an electronic monitoring circuit that includes microprocessor means. A device can include display means that includes a liquid crystal display device. A device can include alarm means connected to an electronic monitoring circuit. A device can include alarm means that selectively provide an audible alarm signal. A device can include alarm means that selectively provide a visual alarm signal. A device can include switch means for selectively controlling the operation of an electronic monitoring circuit. A device can include switch means that includes reset switches connected to an electronic monitoring circuit and to a display means. A device can include position marking means on the front of a watch to assist in the positioning of a golf club, racquet, bat etc., relative to said strap and watch during said swing.

A self contained swing monitoring device can include a watch adapted to be worn on the wrist of the user, accelerometer means mounted in the watch, means to measure the speed of said club, bat, racquet, etc., during said swing.

A swing monitoring system in the form of a wrist mounted unit which includes multi-function instrumentation with extremely high degrees of precision that monitors a plurality of critical components of the swing of a golf club, tennis racquet, baseball bat hockey stick or the like. In particular, motion sensors that discriminate finite changes in the timing and speed of the swing are disposed in a housing mounted on a wrist bank analogous to a common wrist watch or timepiece. In addition, sensors are disposed in the wrist strap for detecting changes in grip pressure during the act of swinging any of the above mentioned equipment. The detected parameters are displayed on a LCD which is part of the instrumentation. Desired parameters can be saved in memory and the components of subsequent swing are compared to those saved, and if they are different, an audible alarm or signal is activated. The exactness of the subsequent trial swings relative to those saved in memory is a function of the handicap or other self designated indicator of skill level of the user.

The invention claimed is:

1. A wrist worn muscle movement monitoring device comprising:

a wrist strap;

a sensor that responds to muscle movement at a wrist wearing the wrist strap; and monitoring circuitry connected to the sensor.

2. The wrist worn muscle movement monitoring device of claim 1 comprising a fastener.

3. The wrist worn muscle movement monitoring device of claim 2 wherein the fastener attaches the wrist strap to a watch casement.

4. The wrist worn muscle movement monitoring device of claim 1 wherein the sensor is embedded in the wrist strap.

5. The wrist worn muscle movement monitoring device of claim 1 wherein the muscle movement comprises movement of a muscle group at the wrist.

6. The wrist worn muscle movement monitoring device of claim 5 wherein the muscle group at the wrist moves toward the elbow.

7. The wrist worn muscle movement monitoring device of claim 1 comprising a battery.

8. The wrist worn muscle movement monitoring device of claim 7 wherein the battery comprises a lithium battery.

9. The wrist worn muscle movement monitoring device of claim 1 comprising a watch casement connected to the wrist strap.

10. The wrist worn muscle movement monitoring device of claim 1 wherein the sensor comprises a piezo-electric sensor.

11. The wrist worn muscle movement monitoring device of claim 1 comprising an analog to digital converter.

12. The wrist worn muscle movement monitoring device of claim 1 wherein the monitoring circuitry comprises a microprocessor.

13. The wrist worn muscle movement monitoring device of claim 1 wherein the wrist strap comprises a wrist band.

14. The wrist worn muscle movement monitoring device of claim 1 wherein the monitoring circuitry issues a signal based at least in part on response of the sensor to muscle movement.

15. The wrist worn muscle movement monitoring device of claim 1 comprising a display that displays information responsive to output from the monitoring circuitry.

* * * * *